US006792961B2

(12) United States Patent
Rosa

(10) Patent No.: US 6,792,961 B2
(45) Date of Patent: Sep. 21, 2004

(54) WASHING TANK FOR BREAKS OF INDUSTRIAL VEHICLES AND LIKE

(75) Inventor: Giuseppe Rosa, Montorso (IT)

(73) Assignee: Rosauto S.r.l., Montebello Vicentino (IT)

( * ) Notice: Subject to any disclaimer, the term of this patent is extended or adjusted under 35 U.S.C. 154(b) by 320 days.

(21) Appl. No.: 10/001,752

(22) Filed: Oct. 24, 2001

(65) Prior Publication Data

US 2002/0050284 A1 May 2, 2002

(30) Foreign Application Priority Data

Oct. 26, 2000 (IT) ..... MI2000A2318

(51) Int. Cl.[7] ..... B08B 3/02

(52) U.S. Cl. ..... 134/111; 134/172; 134/169 A; 134/104.3

(58) Field of Search ..... 134/104 A, 104.3, 134/111, 198, 186, 172, 169 A; 15/345

(56) References Cited

U.S. PATENT DOCUMENTS

| | | | |
|---|---|---|---|
| 2,573,008 | A | 10/1951 | Gorden |
| 3,117,583 | A | 1/1964 | Hearn et al. |
| 3,464,429 | A | 9/1969 | Ehrhardt |
| 4,016,893 | A | 4/1977 | Scott |
| 4,637,413 | A | 1/1987 | Llewellyn et al. |
| 4,791,947 | A | 12/1988 | Holzberger |
| 5,052,422 | A | 10/1991 | Franz et al. |
| 5,265,633 | A | 11/1993 | Knowlton |
| 6,068,003 | A | 5/2000 | Kosofsky et al. |
| 6,306,221 | B1 | 10/2001 | Magliocca |
| 6,367,489 | B1 | 4/2002 | Yamamoto |

FOREIGN PATENT DOCUMENTS

| | | |
|---|---|---|
| DE | 94 11 339 | 12/1994 |
| DE | 298 16 301 | 11/1998 |
| WO | WO96/11072 | 4/1994 |

OTHER PUBLICATIONS

European Search Report.

*Primary Examiner*—Frankie L. Stinson
(74) *Attorney, Agent, or Firm*—Hedman & Costigan, P.C.

(57) ABSTRACT

A washing tank (10) for brakes of industrial vehicles and like, foresees a trolley (11), equipped with a vessel (12) containing the washing liquid, and a collection tank (14). Between the aforementioned vessel (12) and the aforementioned collection tank (14) a first pump (18) is foreseen which draws the washing liquid from the aforementioned vessel (12) and through a first pipe (19), conveys it into the collection tank (14), and a second pump (17) which draws in the liquid and puts it back into the aforementioned vessel (12), through a second pipe (25).

1 Claim, 2 Drawing Sheets

WASHING TANK FOR BREAKS OF INDUSTRIAL VEHICLES AND LIKE

The present invention has as its object a washing tank for brakes of industrial vehicles and like.

More particularly, the washing tank of the invention has mainly, but not exclusively, been designed for washing the brake blocks of industrial vehicles.

In the prior art, brake-washing tanks for lorries already exist, but such tanks are inconvenient and encumbrant.

In fact, the current tanks are very low vessels which contain a certain amount of washing liquid and are on wheels and equipped with a small pump which feeds a brush.

The operator, when he has to change or repair the brakes of a lorry, must first slightly lift it from the ground through a jack, take off the wheel and take off the hub to gain access to the brakes.

The operator then positions the tank full of liquid under the lorry and, through the small pump and the brush, washes the brakes before replacing them.

At the end of the wash the tank containing the liquid is put to one side with its own liquid inside.

However, this system is encumbrant and moreover, since the tank is open, the vapours emanating from the liquid could be potentially dangerous.

Moreover, in this known tank, being very low, the renewal of the liquid becomes a problem, since it cannot be transferred as such, but to do so the whole vessel must be lifted with the help of two people to pour the liquid into another vessel.

A purpose of the present invention is that of realising a washing tank for brakes of industrial vehicles and like which can be used in a safe and rational manner.

Another purpose of the present invention is that of realising a washing tank for brakes of industrial vehicles and like which is convenient and simple to use.

These purposes according to the present invention are achieved by realising a washing tank for brakes of industrial vehicles and like, according to claim 1, to which we refer for the sake of brevity.

Figure 1:
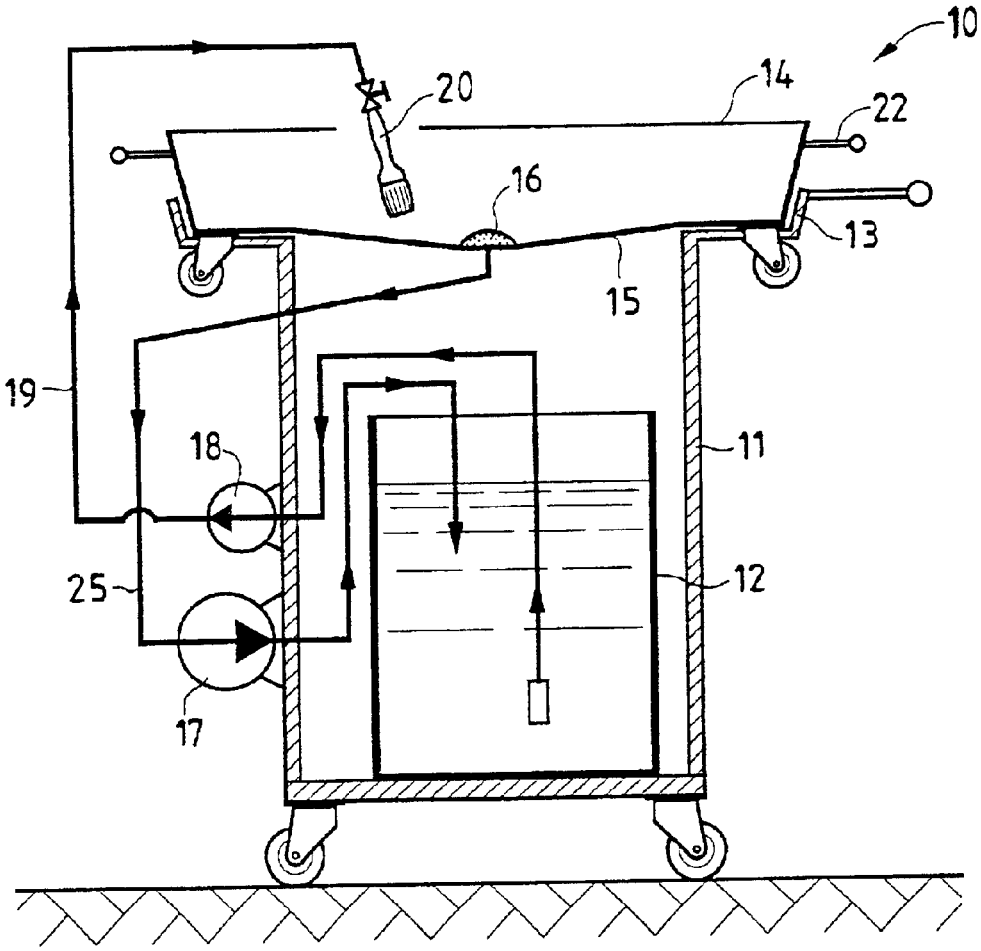
Figure 2:
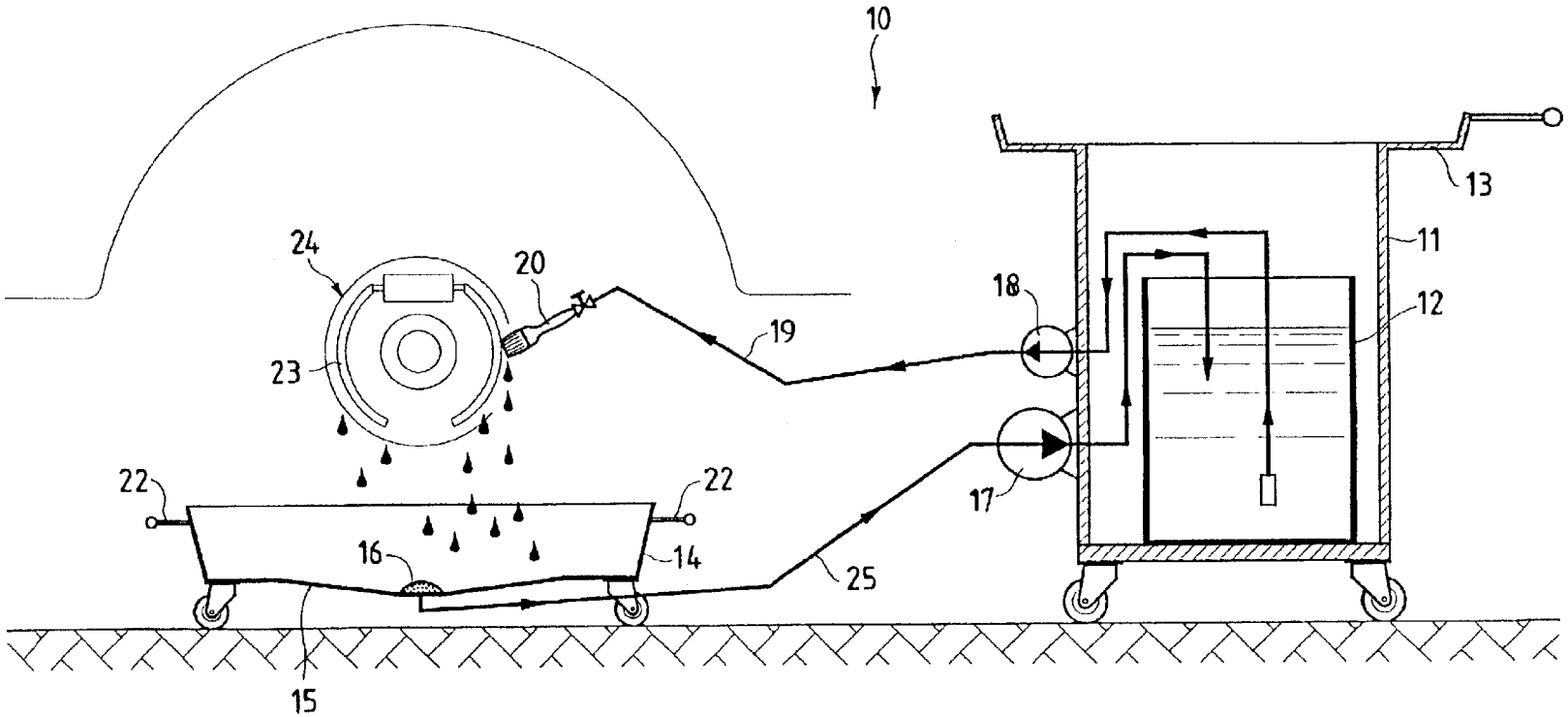

Further characteristics of the invention are defined in the other claims attached to the present application. Further purposes and advantages of the present invention will become clear from the following description and from the annexed drawing, provided simply as an explanatory and non-limiting example, in which:

FIG. 1 represents a schematic view, in section, of a washing tank for brakes of industrial vehicles and like, according to the present invention, in a first configuration; and FIG. 2 represents a schematic view in section, of the washing tank of FIG. 1, in a second configuration.

With particular reference to the figures mentioned, the washing tank for brakes of industrial vehicles and like, according to the present invention, is wholly indicated with the reference number 10.

Firstly, the washing tank 10 of the invention foresees a trolley 11, equipped with a vessel 12 containing the washing liquid.

Above the vessel 12 there is a support 13, with a collection tank 14 supported above it, in the configuration of FIG. 1.

This collection tank 14 has a base angled to a point or area 15 where all of the liquid converges.

In the lowest part there is also a filter 16 from which the pump 17, which is the largest one in the described system, draws to make the washing liquid return inside the vessel 12.

A smaller pump 18 draws the liquid from the vessel 12 and, through a flexible pipe 19 and a brush 20, conveys it into the collection tank 14.

In the use of the tank of the invention, after having removed the wheel of the lorry, the whole trolley 11 is moved closer to the lorry, the collection tank 14 is taken by the appropriate handles 22 and there it is rested on the ground, under the brakes 23, 24.

At this point, the two pumps 17 and 18 commence operation: the smaller first pump 18 is used to draw the liquid from the vessel 12 and, through the flexible supply tube 19 and the brush 20, it allows the brakes 23, 24 to be washed.

The dirty washing liquid is collected by the collection tank 14 and through the second pump 17, which preferably functions at the same time as the first pump 18, is drawn out and put back into the vessel 12, through the pipe 25.

In this way the collection tank 14 always remains empty, easy to clean and to move.

When the collection tank 14 is rested on its support 13 above the vessel 12 for the liquid, it can be used as a normal washing tank for mechanical parts.

At the end of the task, the renewal of the dirty water becomes easy, because it is already inside the vessel 12.

From the description which has been made the characteristics of the washing tank for brakes of industrial vehicles and like, which is object of the present invention, are clear, just as the advantages are also clear.

Finally, it is clear that numerous variants can be brought to the washing tank for brakes of industrial vehicles and like, object of the present invention, all of which are covered by the novelty principles inherent to the inventive idea.

In the practical embodiment of the invention, the materials, the shapes and the sizes of the illustrated details can be whatever according to the requirements and they can be replaced with others which are technically equivalent.

The scope of the invention is defined in the claims attached to the present application.

What is claimed is:

1. Washing tank apparatus (10) for brakes of industrial vehicles which comprises a trolley (11), having a vessel (12) containing the washing liquid, and a collection tank (14) having wheels, said collection tank (14) being detachably mounted on support (13) above vessel (12) and adapted for use when mounted on said support, said vessel (12) being connected to a first pump (18) which draws the washing liquid from vessel (12) through a first pipe (19) which conveys to collection tank (14) through brush (20), and having a second pump (17) mounted on vessel (12), which draws washing fluid from collection tank (14) through a second pipe (25).

* * * * *